United States Patent [19]

Bidwell

[11] Patent Number: 4,484,444

[45] Date of Patent: Nov. 27, 1984

[54] APPARATUS AND METHODS OF AMPLIFYING ENGINE EMISSIONS BY WHICH TO INCREASE THE OVERALL ENGINE EFFICIENCY

[76] Inventor: Howard Bidwell, 56 Aldrich St., Granby, Mass. 01033

[21] Appl. No.: 402,970

[22] Filed: Jul. 29, 1982

[51] Int. Cl.[3] ..... F02B 37/00

[52] U.S. Cl. ..... 60/599; 60/275; 123/536

[58] Field of Search ..... 60/599, 275; 123/536

[56] References Cited

U.S. PATENT DOCUMENTS

| | | | |
|---|---|---|---|
| 2,633,698 | 4/1953 | Nettel | 60/599 |
| 3,311,097 | 3/1967 | Mittelstaedt | 60/275 |
| 3,380,245 | 4/1968 | Mick | 60/290 |
| 3,788,070 | 1/1974 | Camarasa | 60/298 |

FOREIGN PATENT DOCUMENTS

| | | | |
|---|---|---|---|
| 146356 | 7/1931 | Switzerland | 60/599 |

*Primary Examiner*—Douglas Hart
*Attorney, Agent, or Firm*—Ross, Ross & Flavin

[57] ABSTRACT

Method and apparatus for increasing the intensity of the secondary combustion of an internal combustion engine emission, by the injection of fresh air for the purpose of reducing the carbon monoxide content thereof, while simultaneously increasing the carbon dioxide content thereof, while lessening the polluting effects of the emission, and further in which emission heated air is introduced into the engine emission flow to further enhance the intensity of the secondary combustion reaction.

2 Claims, 1 Drawing Figure

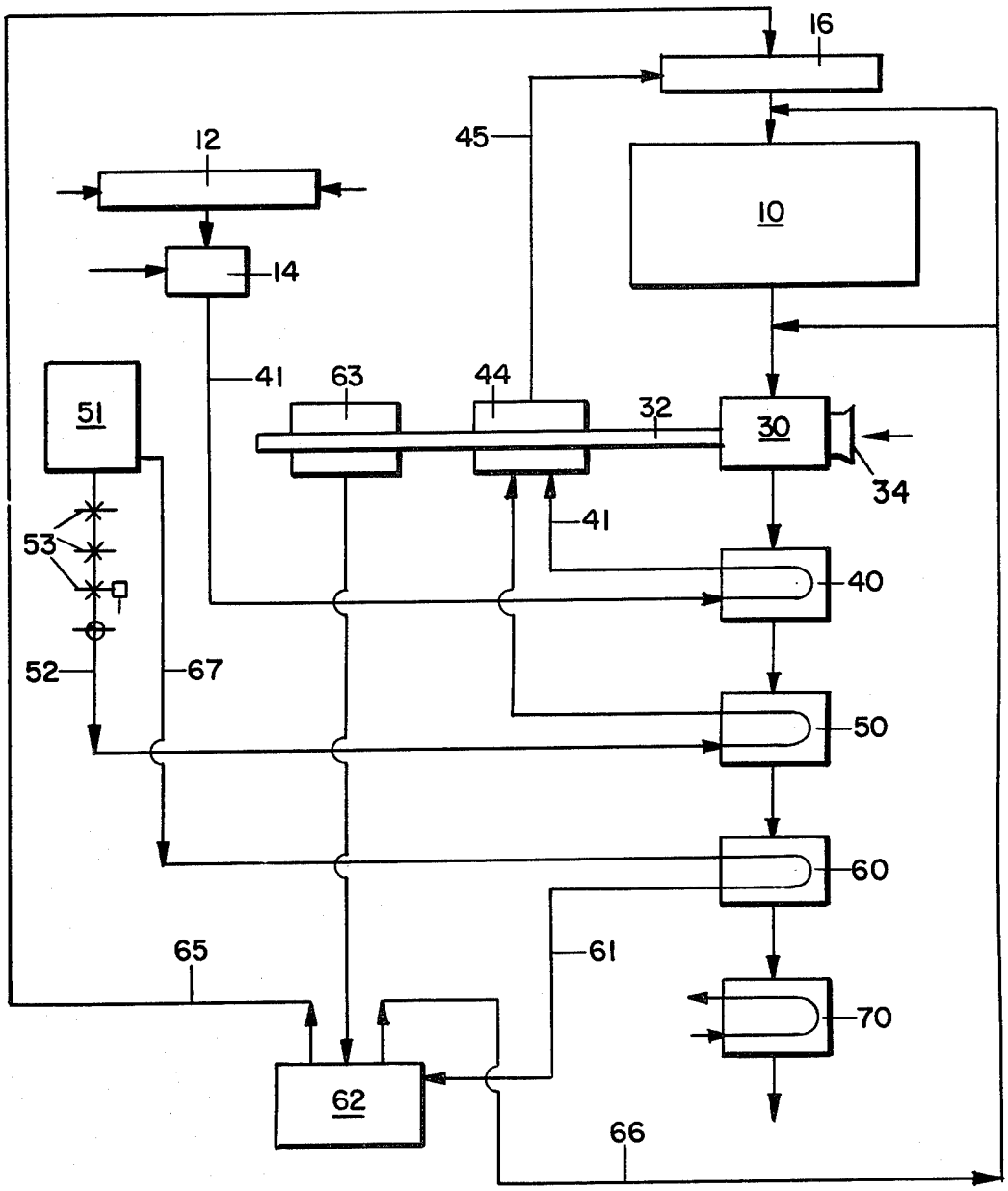
16
12
45
10
14
41
63
44
32
30
51
34
41
53
40
52
67
50
60
65
61
70
62
66

APPARATUS AND METHODS OF AMPLIFYING ENGINE EMISSIONS BY WHICH TO INCREASE THE OVERALL ENGINE EFFICIENCY

BACKGROUND OF THE INVENTION

1. Field of the Invention

Methods of increasing overall engine efficiency while simultaneously extracting the potential energies of an internal combustion engine exhaust.

2. Description of the Prior Art

With the exception of equipment using engine exhaust to propel air-fuel intake mixtures by exhaust-driven turbine type superchargers, and using heat extracted for use similar to that used in the Pogue and other type carbureters and devices, no method or means is known to exist for the "amplification" of or otherwise the "increase" of the energy content of the usual internal combustion engine exhaust emissions as to be made useful and applicable for auxiliary power driving purposes for reducing overall engine efficiency, which is, in substance, the fundamental basic objective of the invention hereof.

That is, there is no evidence available of any practical means to economically improve the quality of the exhaust emissions from internal combustion type engines, regardless of the type of fuel used such as gasoline and diesel oil, by the method of feeding into the engine exhaust emission flame flow, additional "oxidizing agents," such as air, and/or oxygen, by which to increase the potential energies of those emissions for power-take-off purposes and for use in generating desirable engine intake fuel gases such as hydrogen and oxygen which can increase engine efficiency and simultaneously and automatically reduce pollution.

SUMMARY OF THE INVENTION

Purposes of the Invention

The invention teaches apparatus and an interrelated component parts system for improving the efficiency of internal combustion type engines generally, by automatically improving the "nature" of the normally spent gases while simultaneously and collectively exploiting the enhanced energy values thereof by:

1. reactivating to an improved state of secondary combustion gas content, for achieving a more complete burning of the unburned hydrocarbons such as carbon monoxide (CO), to carbon dioxide ($CO_2$) of the exhaust emission by feeding a fresh air charge into the exhaust flame stream by which to improve and increase energy potential for auxilary power driving purposes, 2. exploiting the so-increased energy derived from the improved secondary combustion resulting from the fresh air propagated and supported intensified secondary combustion and resulting increase in gas volume and velocity magnitudes by which to drive an air-cooled air-charging turbine type power-generating rotor and its extended hollow air-cooled supporting shaft and other additional auxiliary accessory apparatus in addition to an intake supercharger, 3. propelling a carbureted air-fuel vapor mixture supercharger rotor for delivering a "conditioned" engine intake flow under increased and above atmospheric pressures, while simultaneously:

4. exploiting the energies of the so improved intensified secondary combustion by which to superdry the vapors of the carbureted air-fuel vapor engine intake mixtures to a more true, complete gaseous state and blended condition, for better in-cylinder combustion, by which to reduce the amount of fuel intake and also the amount of unburned hydrocarbons (CO) carbon monoxide in the engine exhaust, thereby materially improving fuel economy and engine efficiency, 5. propelling a special additional low voltage high amperage electric generator for supplying electric current to an electrolysis type $H_2O$) gas generator as a result by means of the additionally improved and corrected engine exhaust secondary combustion chemical content, sufficiently to drive a turbine wheel and power take off drive shaft extension, 6. supplying low voltage high amperage electric current to a $H_2O$ gas electrolysis generator for supplying hydrogen ($H_2$) gas to the engine exhaust flame secondary combustion generator simultaneously and/or in full or in part and/or otherwise as may separately or jointly be directed to advantage in improving the engine efficiency during normal operation, 7. utilizing part of the heat from the engine exhaust to convert a limited controllable flow of liquid water-alcohol solution to a superheated steam gaseous state prior to blending into the supercharged and/or other carbureted air-fuel engine intake flow stream, 8. utilizing part of the heat from the engine exhaust to raise the temperature of the water within the hydrogen-oxygen gas generator for more rapid gas generation.

BRIEF DESCRIPTION OF THE INVENTION

In accordance with the present invention, the foregoing and other objectives are achieved in a fortified supplementary injected and blended secondary combustion supporting amplified emissions system for internal combustion engines with the energy exploiting mechanisms being manually or automatically rendered operative.

The invention teaches apparatus and methods for treating the normally spent and wasted exhaust gases with supplementary natural oxidizing agents for supporting further amplified and intensified and more complete secondary combustion from which much more additional energy is made exploitable for power-take-off driving of the auxiliary accessory apparatus such as the aforesaid carbureted air-fuel super-charger and hydrogen/oxygen gas generation and its use, that materially reduce engine fuel intake while simultaneously reducing engine load with reduced exhaust back pressure, normally created by the tight confining high frictional restricting gas flow exhaust pipe passageway enclosure and flow restricting muffler and extended tail pipe that prevent natural potential and proper oxidation of the unburned hydrocarbons of the engine exhaust that cause surrounding air pollution, all of which materially reduce engine output caused in part by added conventional pollution control devices.

This invention provides the simple means of blending the oxidating effects of plain fresh air, fortified with additional self-generated oxidizing agent such as oxygen gas to the oxygen-hungry and defficient hot explosive engine exhaust "blow torch" type flame stream.

By the herein disclosed complete unified means of interrelated devices by which the sound wave noises of the incompletely consumed and partially expanded gases released from under considerable pressure from the engine cylinder exhaust parts, are greatly muffled in the process of being "reactivated" within the secondary and more complete combustion chemical activity reactions as to produce additional gas volume and velocities resulting in additional exploitable energy as to be sufficient to propel a series of additional devices such as the mentioned engine intake supercharger electric generator and the hydrogen gas intake feed and extra exhaust heat available for supplemental purposes, all sufficient to improve the efficiency of a relatively lightweight straight line internal combustion engine over that of the usual complicated more massive and heavier V-type engine, all to the end of reduced manufacturing, operation and maintenance costs.

By virtue of the aforesaid general exploitation of the engine exhaust gas flow velocity energies, the invention comprehends a significant increase in engine output while simultaneously realizing a substantial reduction in gas velocity and flow as to lessen exhaust back pressure and to deaden tail-pipe noise.

BRIEF DESCRIPTION OF THE DRAWING

The drawing is a simplified schematic flow line diagram showing the flow direction between the more essential component parts of one form of the basic principle of the invention.

DESCRIPTION OF THE INVENTION

In this flow-line scheme of the invention, the exhaust from a conventional internal combustion engine 10 is directed to one form of a new and unique type of free fresh air flow inducing air cooled exhaust driven turbine rotor component unit 30, suitably housed, enclosed and direct-connectedly attached to engine 10 exhaust manifold outlet, such that the exhaust flame flow impinges directly against the turbo rotor.

Engine 10 air intake is drawn through the usual conventionl air filter 12 and carburetor 14, duct 41 to a simple outer sleeve over exhaust pipe type of heat exchanger 40 thence to air-fuel vapor super charger 44, thence through duct 45 to engine intake manifold 16.

For the purpose of providing for the incorporation of the age old practice of admitting an adjustably control regulated limited trickle flow of water-alcohol solution into the air-fuel mixture flow, reservoir 51 with necessary sight feed, stops, regulating valve and electro-magnetic shut-off, all grouped under controls 53, may be employed with the liquid directed via tube 52 to a "tubing wound around the exhaust pipe" type of heat exchanger 50 thence to supercharger 44, after the liquid solution has been converted to superheated steam during normal engine operation after warm-up.

Engine intake flow supercharger 44 and electric generator 63 are shown direct-driven by the rotation of exhaust driven rotor within component 30 by virtue of air cooled hollow shaft 32 or by any other suitable means, by which suitable electric current is supplied to hydrogen-oxygen gas generator 62 during normal operation of engine 10, whereby hydrogen gas is fed into engine 10 intake manifold 16 via duct 65 while oxygen gas may be selectively and variably fed in part or in full flow into engine 10 exhaust flame via duct 66 and/or may be fed into engine intake manifold 16 and/or suitably proportioned and variably fed as desired to both engine intake and engine exhaust flows by valve controls (not shown), during periods of normal engine 10 operation.

Heat exchanger 70 may of any suitable type and kind to suit any kind of service such as space heating, water heating to fit the type or service. The engine may be in operation for such as in auto passenger cars, trucks, truck tractors, R.R. locomotive (internal combustion) types, marine service types and also stationary service engine types where extracting all heat from engine exhaust is advantageous and exhaust driven turbine type units are practical.

OPERATION

Engine 10 is started in the usual manner by electric starter or other means (not shown) with generator 63 normally discounted by any suitable means (not shown) and liquid feeding controls 53 normally closed, and engine intake supercharger 44 disconnected or not as the type of service may dictate, by any suitable means (not shown), after which on a few seconds of normal warm-up depending the engine size, type of service and type of engine, diesel or otherwise, intake air supercharger 44 is started if previously disconnected, liquid controls 53 are put in operating position and electric generator 63 put in operation by any suitable means (not shown), and $H_2$-O gas generator checked for normal functioning with oxygen supply arranged for distribution as may fit the type of service and occasion.

Exhaust driven air inducting turbine rotor within unit 30 is normally always free running, preferably under some load in addition to its load of propeling fresh air being drawn through suitably screened intake air opening 34 and also hollow shaft 32, and the air cooled internal and external vaning of the air injecting exhaust propeled rotor within aforesaid suitable housing unit 30, by which the fresh air is blended directly into the engine exhaust flame stream and the added oxygen gas flow from gas generator 62 via duct 66, all being subjected to the extreme agitation of the high speed rotation of the exhaust propeled turbine rotor by which an extremely thorough blending of the exhaust, air and oxygen gases result in a state of high secondary combustion by which the unburned hydrocarbons, carbon monoxide (CO) are consumed and converted to a state of more complete combustion of higher carbon dioxide $CO_2$ content, thereby generating and creating additional available exploitable energy, for engine intake supercharging and hydrogen-oxygen gas generation by which to substantially improve engine efficiency and reduce exhaust polluting effects and eliminate the need for costly back pressure causing power robbing, troublesome added anti-pollution type devices.

I claim:

1. In combination with an internal combustion engine having intake and exhaust manifolds, a turbo rotor connected to and driven by the exhaust gases from the exhaust manifold, means for charging fresh air into the turbo rotor for mixing with the exhaust gases, air intake means, a carburetor for mixing air received from the air intake means with fuel delivered to the carburetor, a first heat exchanger connected to exhaust gas from the turbo rotor for heating the air fuel mixture from the carburetor, a water-alcohol reservoir, a second heat exchanger connected to exhaust gas from the turbo rotor for heating the water-alcohol mixture from the water-alcohol reservoir, an air-fuel-vapor supercharger driven by the turbo rotor and mixing the heated carbureted air-fuel mixture and the vapor of the heated water-alcohol mixture before delivery to the intake manifold.

2. The combination of claim 1, and further including:

an electric generator driven by the turbo rotor, a hydrogen-oxygen generator driven by the electric generator for delivering hydrogen to the intake manifold and oxygen to the exhaust manifold.

* * * * *